United States Patent [19]

Kaczerginski et al.

[11] Patent Number: 4,491,687

[45] Date of Patent: Jan. 1, 1985

[54] METHOD OF MANUFACTURING A COMPOSITE TYPE STAY INSULATOR, AND AN INSULATOR OBTAINED BY THE METHOD

[75] Inventors: Alexandre Kaczerginski, Bellerive sur Allier; Jean-Jacques Kaminski, Saint-Yorre, both of France

[73] Assignee: Societe Anonyme dite: Ceraver, Paris, France

[21] Appl. No.: 400,718

[22] Filed: Jul. 22, 1982

[30] Foreign Application Priority Data

Aug. 5, 1981 [FR] France ..... 81 15202

[51] Int. Cl.[3] ..... H01B 17/02

[52] U.S. Cl. ..... 174/178; 29/631; 156/172

[58] Field of Search ..... 174/140 S, 176, 177, 174/178, 179, 209; 29/631; 156/171, 172

[56] References Cited

U.S. PATENT DOCUMENTS

| | | | |
|---|---|---|---|
| 2,997,529 | 8/1961 | Fink | 174/179 X |
| 3,261,910 | 7/1966 | Jacquier | 174/178 |
| 3,325,584 | 6/1967 | Herzig | 174/179 X |
| 3,553,978 | 1/1971 | Williams | 174/177 X |
| 3,567,541 | 2/1971 | Kaczerginski | 174/177 X |
| 3,839,593 | 10/1974 | Meier et al. | 174/178 X |
| 3,850,722 | 11/1974 | Kreft | 156/172 |

FOREIGN PATENT DOCUMENTS

| | | | |
|---|---|---|---|
| 1109151 | 4/1968 | United Kingdom | 174/178 |
| 1505875 | 3/1978 | United Kingdom | 174/178 |
| 1601379 | 10/1981 | United Kingdom | 174/179 |

*Primary Examiner*—Laramie E. Askin

*Attorney, Agent, or Firm*—Kenyon & Kenyon

[57] ABSTRACT

A composite type stay insulator comprises a central mandrel (4) made of insulating foam and having its ends (5) glued at (6) to two metal end pieces (1). The glue may be optionally conductive or semiconductive. A skein winding (8) of insulating resin-impregnated fibers is made around the end piece and mandrel assembly to transmit traction forces from a shoulder (7) on one of the end pieces to a corresponding shoulder on the other. The winding is then covered with a resilient insulating covering (9) which is optionally fitted with fins.

10 Claims, 2 Drawing Figures

METHOD OF MANUFACTURING A COMPOSITE TYPE STAY INSULATOR, AND AN INSULATOR OBTAINED BY THE METHOD

The invention relates to a method for manufacturing a composite type stay insulator, and to an insulator obtained by the method. Insulators of this type have to withstand high traction forces, eg. under the effect of mechanical loading, lying in the range 20 to 200 tons.

BACKGROUND OF THE INVENTION

French Pat. No. 1,390,405 (corresponding to U.S. Pat. No. 3,261,910) describes a stay insulator comprising two metal end pieces connected together by a tube having fiber glass wound around it to constitute a cylindrical sheet having part spherical caps at each end against which respective shoulders of the metal end pieces are brought to bear.

In order to improve the mechanical and electrical performance of such insulators, French Pat. No. 2,198,231 (corresponding to U.S. Pat. No. 3,839,593) proposes surrounding the part spherical end caps with a glass fiber binding. This solution has not been successful because cracking and unsticking have been observed between the binding and the caps due to their different temperature expansion coefficients. Proposals have also been made to fill the central tube with an electrically insulating fluid such as an insulating oil or sulphur hexafluoride to fill the cracks and to compensate for the temperature dilations and relative extensions due to conditions of use and to climatic conditions (wind, frost), inter alia.

Preferred embodiments of the present invention provide a composite type of stay insulator of simplified structure that avoids, in particular, the need to use an insulating fluid together with any sealing means and volume compensating means required thereby.

SUMMARY OF THE INVENTION

The present invention provides a method of manufacturing a composite type stay insulator comprising two metal end pieces provided with anchoring shoulders, wherein:

the two end pieces are glued to the ends of a mandrel of insulating foam;

resin impregnated insulating fibers are skein wound around the mandrel and said anchoring shoulders of the metal end pieces; and a resilient insulating covering is adhered to said winding and the portions of the end pieces adjacent to said winding.

The present invention also provides a stay insulator comprising two metal end pieces wherein said end pieces are connected to each other by three components that are also made fast to one another, said three components being:

a central mandrel of insulating foam, having its ends glued to respective ones of the end pieces;

a skein winding of insulating resin-impregnated fibers surrounding said mandrel and anchoring shoulders on said end pieces; and a resilient insulating covering comprising a sheath optionally fitted with fins, adhered to the mandrel-winding-end piece assembly.

The combination of these three insulating components in accordance with the invention and suitably made fast to the end pieces enables a simplified stay insulator to be obtained capable of withstanding very high traction forces.

The central mandrel which acts as a support for the filament winding may be a polyurethane foam, a polyisocyanurate foam, an epoxy foam particularly with sulphur hexafluoride as foaming agent, or any analogous foam. Such a foam performs well at temperatures up to about 150° C. so as to withstand treatment of the resin on the insulating fibers. It is sufficiently flexible to absorb the thermal shrinking of the winding that occurs after said treatment in addition to the shrinking due to the polymerisation per se of said resin. However, it is sufficiently rigid to enable the insulating fibers to be put in place.

The fibers of the winding may be any insulating material that has good mechanical strength regardless of whether it is made of organic or inorganic material. Fibers made of any of the following may be used: glass, silica, polyester, aramide, or the like.

The external insulating covering is made from a material chosen from: EPDM (Ethylene-Propylene-Diene-Monomer), silicones, polyurethanes, epoxies or the like. It may be made, in a manner known per se, by complete or partial moulding.

BRIEF DESCRIPTION OF THE DRAWINGS

Two embodiments of the invention are described by way of example, with reference to tha accompanying drawings, in which.

MORE DETAILED DESCRIPTION

Figure 1:
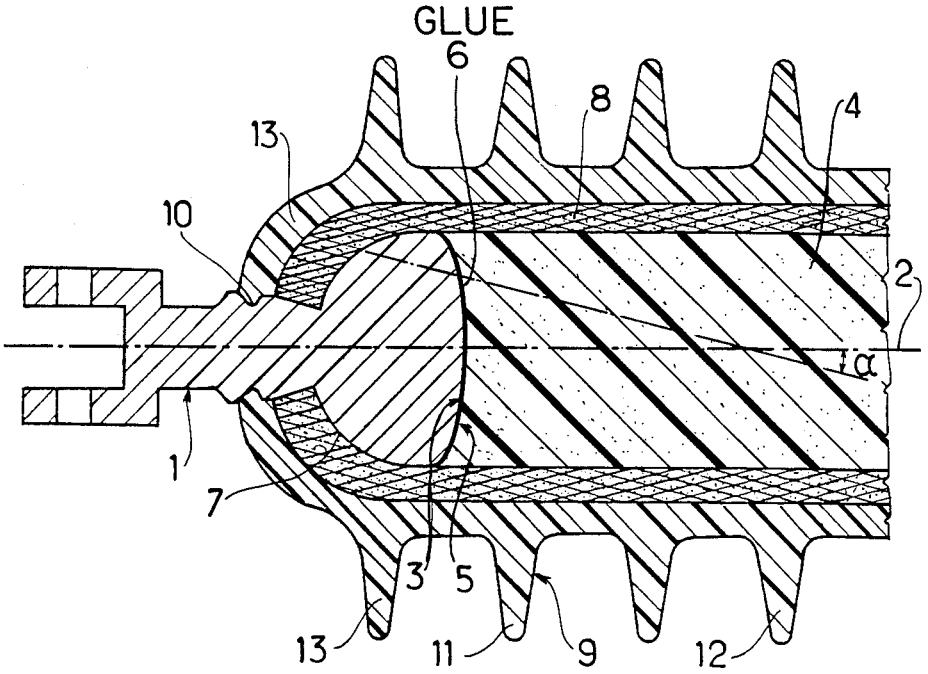
FIG. 1 is a diagrammatic partial section through an example of an insulator in accordance with the invention.

The insulator shown in FIG. 1 is made as follows:

Two end pieces 1 are set up in a jig facing each other along an axis 2. The end pieces may be made of hot galvanized forged steel, for example, and their facing faces 3 are treated for subsequent gluing 6.

A cylindrical mandrel 4 of foam as defined above is interposed between the faces 3 of the end pieces 1. The faces 5 of the mandrel are machined beforehand to fit the faces 3 thereby maintaining the electrical characteristics of the insulation. The faces 3 and 5 are then hot glued together, preferably under a vacuum, for example by means of a film of initially solid glue 6 which becomes tacky on heating and is self hardening. The glue may optionally be conductive or semiconductive.

The surface of the mandrel 4 is then impregnated (optionally under a vacuum) with glue whose viscosity is suitable to ensure that the open pores of the foam are filled with glue. The glues may be rendered thixotropic or pre-gelled. A skein 8 of insulating fibers is then wound over the assembly constituted by the mandrel 4 and shoulders 7 on the end pieces. This is done in a conventional filament winding manner, and the fibers are impregnated at the same time with resin. Let $\alpha$ be the fiber winding angle relative to the axis 2, then the angle $\alpha$ is chosen to be as small as possible over the cylindrical portion of the winding in order to reduce elongation and radial compression forces under traction.

The surface of the winding 8 is then treated to adhere to the covering 9. The covering may comprise, for example, an end 13 anchored in the end piece 1 at 10 where also treated for adherence, followed by fins 11, 12.

It may be moulded over the winding in a single pass in such a manner that its material, eg. silicone, is cast without applying any notable pressure on the assembly of end pieces-mandrel-winding.

In contrast, if the chosen material, eg. EPDM, requires high pressure injection (at about 150 to 500 bars), there is a danger of producing large stresses around the end piece to mandrel connections, which may damage the mandrel.

Figure 2:
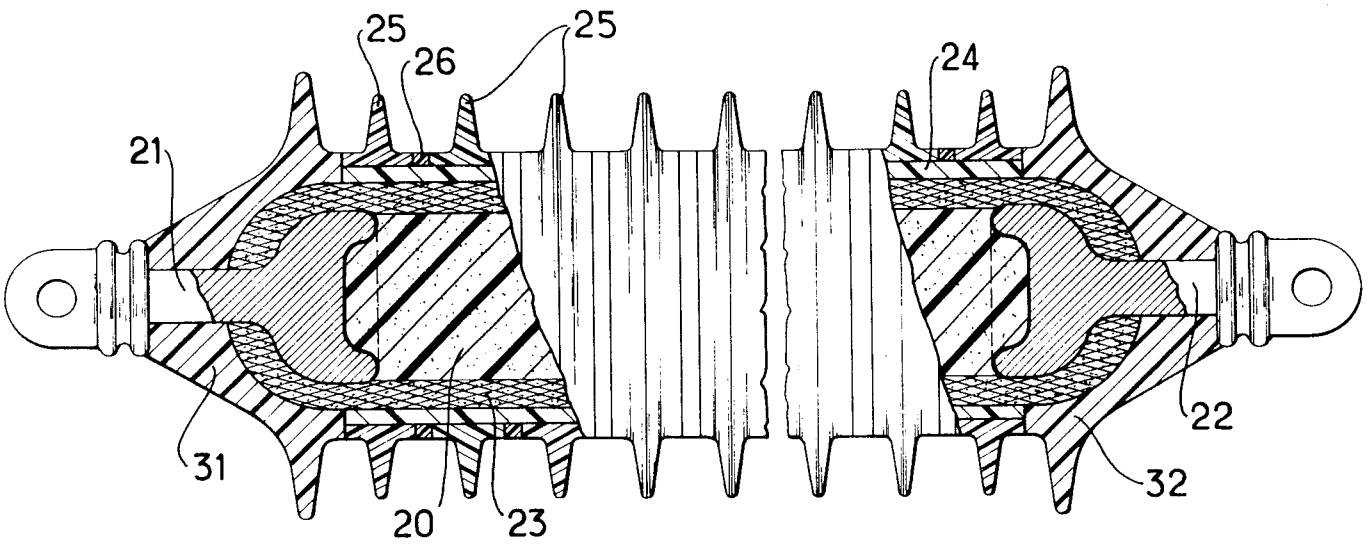
FIG. 2 is a section through a variant.

FIG. 2 depicts the arrangement of a covering in such a case. The insulator shown has two end pieces 21 and 22, a central foam mandrel 20 and a skein winding 23. Initially a sheet of raw EPDM is spiralled solely around the portion surrounding the mandrel 20 to produce a covering 24. Fins 25 of vulcanised EPDM are then threaded over the resulting raw covering together with washers 26 of raw EPDM in between the fins. The covering 24 and the washers 26 are then vulcanised, while the uncovered ends of the winding 23 are protected. Then the assembly is put in a mould where the terminal fins 31 and 32 of EDPM are moulded either simultaneously or one after the other.

We claim:

1. A method of manufacturing a composite type stay insulator including two metal end pieces having anchoring shoulders, the method comprising:

gluing the two metal end pieces to a mandrel of insulating foam;

skein winding resin impregnated insulating fibers around the mandrel and said anchoring shoulders of the metal pieces; and adhering a resilient insulating covering to said winding and to portions of the end pieces adjacent to said winding.

2. A method according to claim 1, wherein the step of adhering an insulating covering comprises:

adhering a partial covering initially over the surface of the portion of the winding on the mandrel and then molding terminal fins over the end portions of the winding and over said portions of the end pieces adjacent to said winding.

3. A composite type stay insulator comprising:

an insulating foam mandrel having two ends;

two metal end pieces having anchoring shoulders, one end piece being glued to one end of the mandrel and the other end piece being glued to the other end of the mandrel;

a layer of resin impregnated insulating fibers skein wound around the mandrel and said anchoring shoulders of the metal end pieces; and a resilient insulating covering adhered to said winding and to portions of the end pieces adjacent to said winding.

4. A composite type stay insulator according to claim 3, wherein the insulating foam of the mandrel is selected from the group consisting of polyurethane foam, polyisocyanurate foam, and epoxy foam.

5. A composite type stay insulator according to claim 4, wherein the insulating foam of the mandrel is an epoxy foam, and sulfur hexafluoride is used as a foaming agent.

6. A composite type stay insulator according to claim 3, wherein said insulating fibers are selected from the group consisting of glass fibers, silica fibers, polyester fibers, and aramide fibers.

7. A composite type stay insulator according to claim 3, wherein the material of said resilient insulating covering is selected from the group consisting of EPDM, silicones, polyurethanes, and epoxies.

8. A composite type stay insulator according to claim 3, wherein the end pieces are glued to the ends of the mandrel by a glue that is initially solid, that becomes sticky on heating, and that is self hardening.

9. A composite type stay insulator according to claim 8, wherein said glue is conductive.

10. A composite type stay insulator according to claim 8, wherein said glue is semiconductive.

* * * * *